US006576296B1

(12) United States Patent
Yapel et al.

(10) Patent No.: US 6,576,296 B1
(45) **Date of Patent: *Jun. 10, 2003**

(54) WEB COATING METHOD AND APPARATUS FOR CONTINUOUS COATING OVER SPLICES

(75) Inventors: Robert A. Yapel, Oakdale, MN (US); Aparna V. Bhave, Woodbury, MN (US); Timothy J. Edman, Stillwater, MN (US); Bernard A. Scheller, Roseville, MN (US); Lawrence B. Wallace, Newport, MN (US); Jerry L. Warren, Medford, OR (US)

(73) Assignee: 3M Innovative Properties Company, St. Paul, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/037,625

(22) Filed: Mar. 10, 1998

(51) Int. Cl.[7] ..... B05D 1/26; B05C 5/00

(52) U.S. Cl. ..... 427/294; 427/402; 427/420; 118/50; 118/410; 118/411

(58) Field of Search ..... 427/294, 402, 427/420; 118/50, 410, 411

(56) References Cited

U.S. PATENT DOCUMENTS 3,916,043 A 10/1975 Fowble
4,808,444 A 2/1989 Yamazaki et al.
5,154,951 A 10/1992 Finnicum et al.
5,780,109 A * 7/1998 Yapel et al. ..... 427/294

FOREIGN PATENT DOCUMENTS

DE 33 09 345 A1 9/1984
EP 0 119 850 A1 9/1984
JP 58-88074 * 5/1983

OTHER PUBLICATIONS

Abstract of DE 3309343 A and US 4545321, Sep. 1984.*

* cited by examiner

*Primary Examiner*—Katherine A. Bareford
(74) *Attorney, Agent, or Firm*—Brian E. Szymanski

(57) ABSTRACT

A method and apparatus for continuously coating moving web and splices with a coating fluid. The system includes a slide coating die having a slide surface with at least one feed slot for extruding the coating fluid onto the moving web. The slide coating die defines a coating gap with the moving web. The coating gap is adjustable between a coating position and a splice coating position. A web guide is positioned to guide the moving web in a first direction past the slide coating die such that a coating bead of the coating fluid can be formed in the coating gap. A vacuum system is positioned to generate a reduced pressure condition along a lower surface of the slide coating die. The vacuum system defines a vacuum gap with the moving web. The vacuum gap is adjustable independent of the coating gap between a coating position and a splice coating position. A detector signals an increase in web thickness. A controller is functionally connected to the detector. The controller adjusts the coating gap and the vacuum gap to the splice coating position in response to an increase in web thickness in excess of a predetermined magnitude while maintaining a stable coating bead.

24 Claims, 5 Drawing Sheets

WEB COATING METHOD AND APPARATUS FOR CONTINUOUS COATING OVER SPLICES

FIELD OF THE INVENTION

The present invention relates to a web coating method and apparatus for maintaining a stable coating bead while coating over splices.

BACKGROUND OF THE INVENTION

The production of high quality articles, particularly photographic, photothermographic, and thermographic articles, consists of applying a thin film of a coating solution onto a continuously moving substrate or web. Thin films can be applied using a variety of techniques including: dip coating, forward and reverse roll coating, wire wound rod coating, blade coating, slot coating, slide coating, and curtain coating. Coatings can be applied as a single layer or as two or more superimposed layers. Although it is usually most convenient for the substrate to be in the form of a continuous web, it may also be formed of a succession of discrete sheets.

Slide coaters have been used extensively since the 1950s in the photographic and related industries for coating aqueous photographic emulsions with relatively low viscosity (less than 100 cP). In slide coating, it is well known to start and stop coating of a moving web by means known as "pick-up." In the pick-up phase, the flow of the coating liquid is established with the coater die retracted from the web. The coating liquid drains over the die edge into a vacuum box and drain. Once the flows of all the coating liquids are stabilized from all the feed slots of the slide coating die, the die and vacuum box are moved into the coating position in a rapid manner with the web moving at the desired coating speed.

Mechanical disturbances such as nicks in the die edge can cause streak-type defects to be formed in the coated article. Contamination disturbances that may cause streaking include dirt particles lodged near the coating bead, dried or semi-dried particles of coating compound, and non-uniform wetting of the contact line of the coating liquid on the coating die edge. Non-uniform wetting on the die edge, especially after pick-up, appears to be an important factor when coating fluids containing volatile solvents. For example, contamination may adhere to the front face and/or die edge of the slide coating die. That contamination may lead to a non-uniform wetting line and possible streaking of the coating compound.

The coating gap between the moving web and the coating die is typically less than about 4 millimeters (0.157 inch). Web splices, debris on, or defects in, the web in excess of the coating gap can cause serious damage to the coating die. It is common practice to retract the coating die, and break the coating bead, to permit web splices to pass through the coating gap. After the web splice passes the coating gap, the pick-up cycle must be repeated to reestablish the coating bead.

Another problem related to slide coating is contamination of vacuum ports and drains in the vacuum box when the die is retracted from the moving web (i.e., no coating bead is present) and the coating liquid is flowing freely. Contamination of the vacuum ports and drains can lead to unstable vacuum operation causing defects and eventually requiring cessation of the coating operation to clean the vacuum box and ports. This problem is exacerbated with high viscosity fluids (about 100–10,000 centipoise or greater) that contain volatile solvents that dry much faster than water (such as methyl ethyl ketone, tetrahydrofuran, or methanol).

FIG. 1 is a schematic illustration of the interface between a coating fluid 20 traversing a top surface 22 of the coating bar 24 and a moving web 26. Front face 28 of the coating bar 24 may include a durable, low surface energy portion. The low energy portion is intended to provide the desired surface energy properties to specific locations to prevent build-up of dried material. Details regarding the process of making such durable, low surface energy portions are disclosed in commonly assigned U.S. patent application Ser. No. 08/659,053 filed May 31, 1996.

When the coating bar 24 is moved into the coating position for pick-up, as illustrated in FIG. 1, a stable coating bead 30 is formed in coating gap 32 between die edge 34 and the moving web 26. The coating gap 32 is typically between 0.0254 mm and 3.81 mm. The coating bead 30 has a static wetting line 36 along the front face 28 and a dynamic wetting line 38 on the moving web 26. The pressure just under lower meniscus 40 is preferably maintained below atmospheric pressure by a vacuum box (not shown) to stabilize the coating bead 30.

If the coating process needs to be interrupted, such as when a web splice passes the coating gap 32, the coating bar 24 and vacuum box assembly can be retracted from the web 26 until resumption of the coating is desired. Retracting the coating bar 24 increases the coating gap 32. The movement of the coating bar 24, disruption of the vacuum force on the coating bead 30 and/or the increase in the coating gap 32 typically destabilizes or breaks the coating bead 30. A significant amount of web 26 may need to be advanced before a stable coating bead 30 is reestablished, resulting in wasted coating fluid 20 and web 26.

In slide coating, it is known to deckle the coating width for various reasons such as for different products and formats. Deckling often results in unwanted leakage of air into the vacuum box because the coating bead bridging the gap between the web and the front of the coating bar is typically narrower than the width of the coating bar. Leakage is more pronounced in modern die lip designs, such as square lips, that offer little resistance to air flow. Vacuum leakage into the vacuum box is particularly troublesome because it becomes difficult to maintain an adequate level of vacuum and because the excessive volume of air flow can destabilize the coating bead.

SUMMARY OF THE INVENTION

The present invention relates to a web coating method and apparatus for continuously coating over splices with a coating fluid. The present method and apparatus permit coating over splices with minimal splice generated waste by eliminating the retraction and pick-up cycle.

The apparatus includes a coating die defining a coating gap with the moving web. The coating gap is adjustable between a coating position and a splice coating position. A web guide is positioned to guide the moving web in a first direction past the coating die such that a coating bead of the coating fluid can be formed in the coating gap. A vacuum system is positioned to generate a reduced pressure condition along a lower surface of the coating die. The vacuum system defines a vacuum gap with the moving web. The vacuum gap is adjustable independent of the coating gap between a coating position and a splice coating position. A detector signals an increase in web thickness. A controller is functionally connected to the detector. The controller adjusts the coating gap and the vacuum gap to the splice coating position in response to an increase in web thickness in excess of a predetermined magnitude while maintaining a stable coating bead. In one embodiment, the coating die is a slide coating die.

In one embodiment, the vacuum system includes a vacuum box with a front seal opposite the moving web upstream of the coating gap. The front seal rotates away from the moving web in the splice coating position. In the illustrated embodiment, the web guide is a support roll. The support roll moves horizontally away from the coating gap in the splice coating position.

In one embodiment, the controller is capable of adjusting a magnitude of the reduced pressure condition in response to the detector signaling an increase in web thickness. The change in the magnitude of the reduced pressure condition preferably corresponds to the increase in web thickness reaching the coating gap. In another embodiment, the slide coating die has a die edge with a centrally located coating portion interposed between a pair of coating gap seals. The coating gap seals comprise vacuum seal land areas having a contour corresponding to a contour of the web guide.

The invention is also directed to a method for continuous coating of a moving web and splices with a coating fluid. A coating die is located opposite the moving web. The coating die defines a coating gap with the moving web in a coating position. The moving web is guided in a first direction past the coating die such that a coating bead of the coating fluid is formed in the coating gap. A reduced pressure condition is generated along a lower surface of the coating bead. An increase in web thickness is signaled to a controller. A vacuum gap is adjusted to the splice coating position in response to an increase in web thickness. The coating gap is adjusted to the splice coating position independently of the vacuum gap in response to an increase in web thickness in excess of a predetermined magnitude while maintaining a stable coating bead.

DETAILED DESCRIPTION OF THE PREFERRED EMBODIMENTS

The present invention relates to a web coating method and apparatus for maintaining a stable coating bead while coating over splices. An unstable coating bead is subject to fluctuations and non-uniformity of the wetting lines, such as movement of the static wetting line along the die edge, movement of the dynamic wetting line on the moving web, and necking of the coating bead along the edges. A stable coating bead refers to generally laminar flow of the coating fluid, and dynamic and static wetting lines that exhibit minimal movement along the moving web and die edge, respectively.

Figure 1:
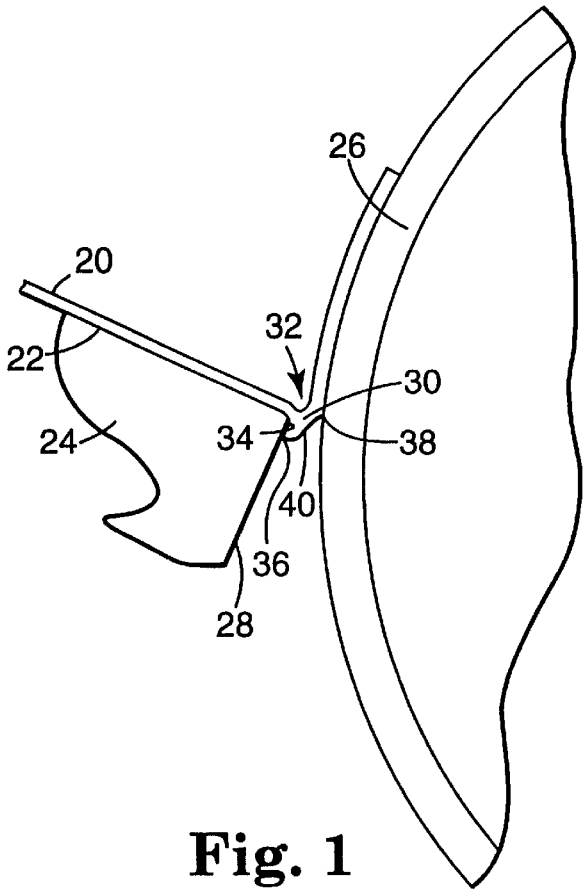
Fig. 1 (PRIOR ART)
FIG. 1 is a schematic illustration of an interface of a slide coating die with a moving web as is known in the art.
Figure 2:
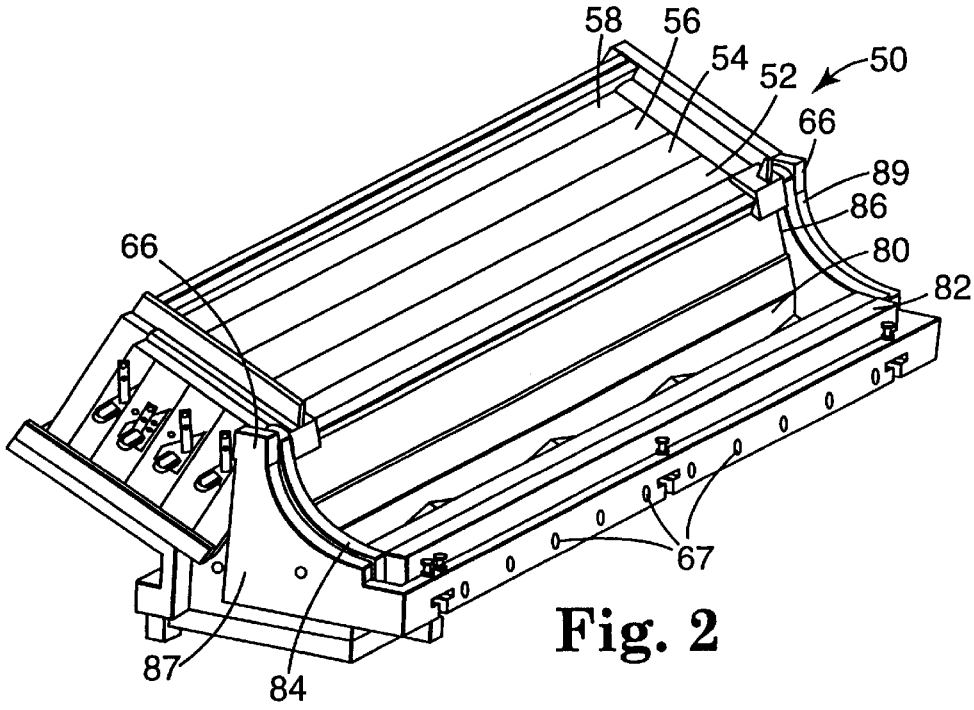
FIG. 2 is a perspective view of an exemplary slide coater assembly.
Figure 3:
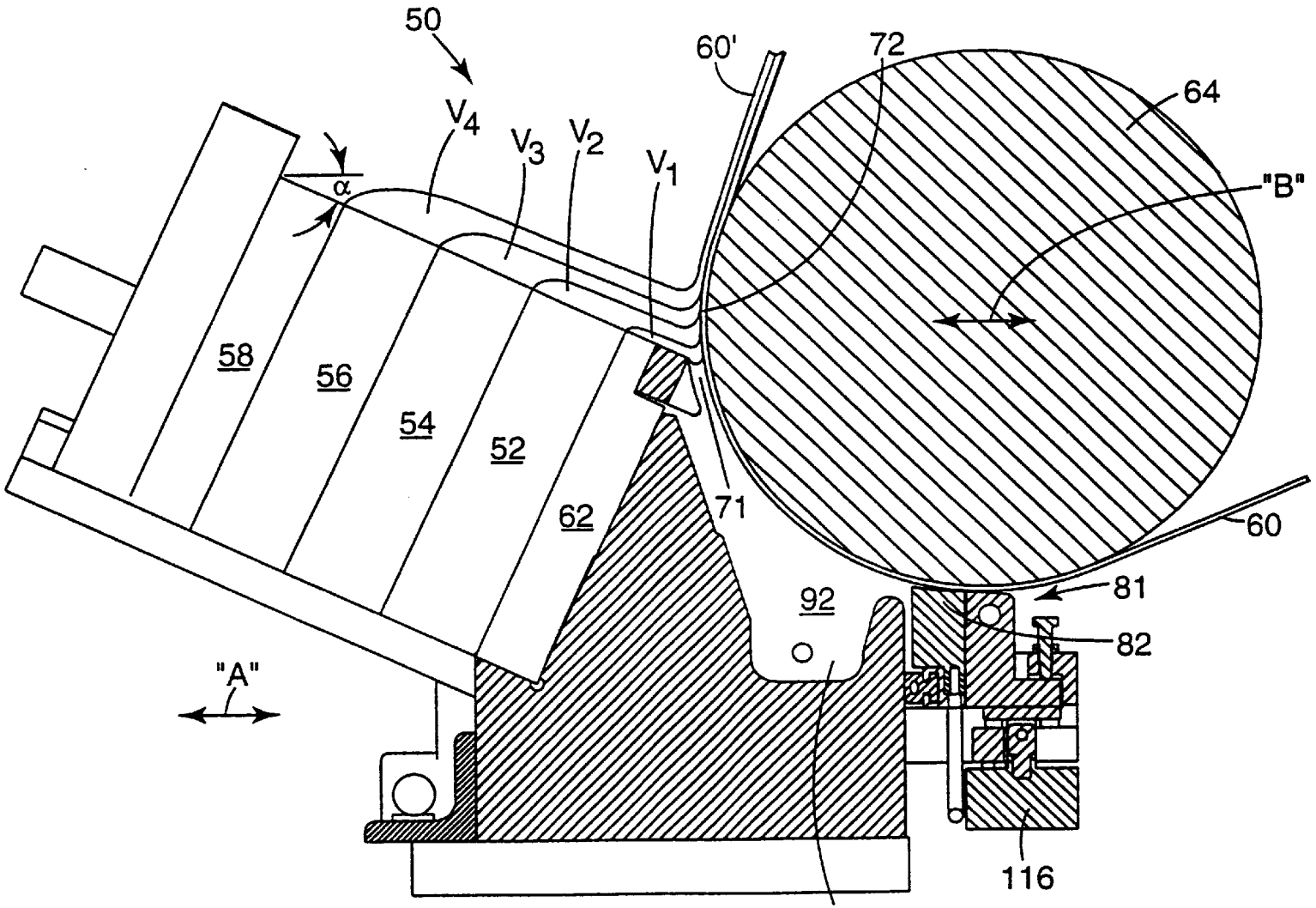
FIG. 3 is a side sectional view of the slide coating assembly of FIG. 2 in a coating configuration.
Figure 4:
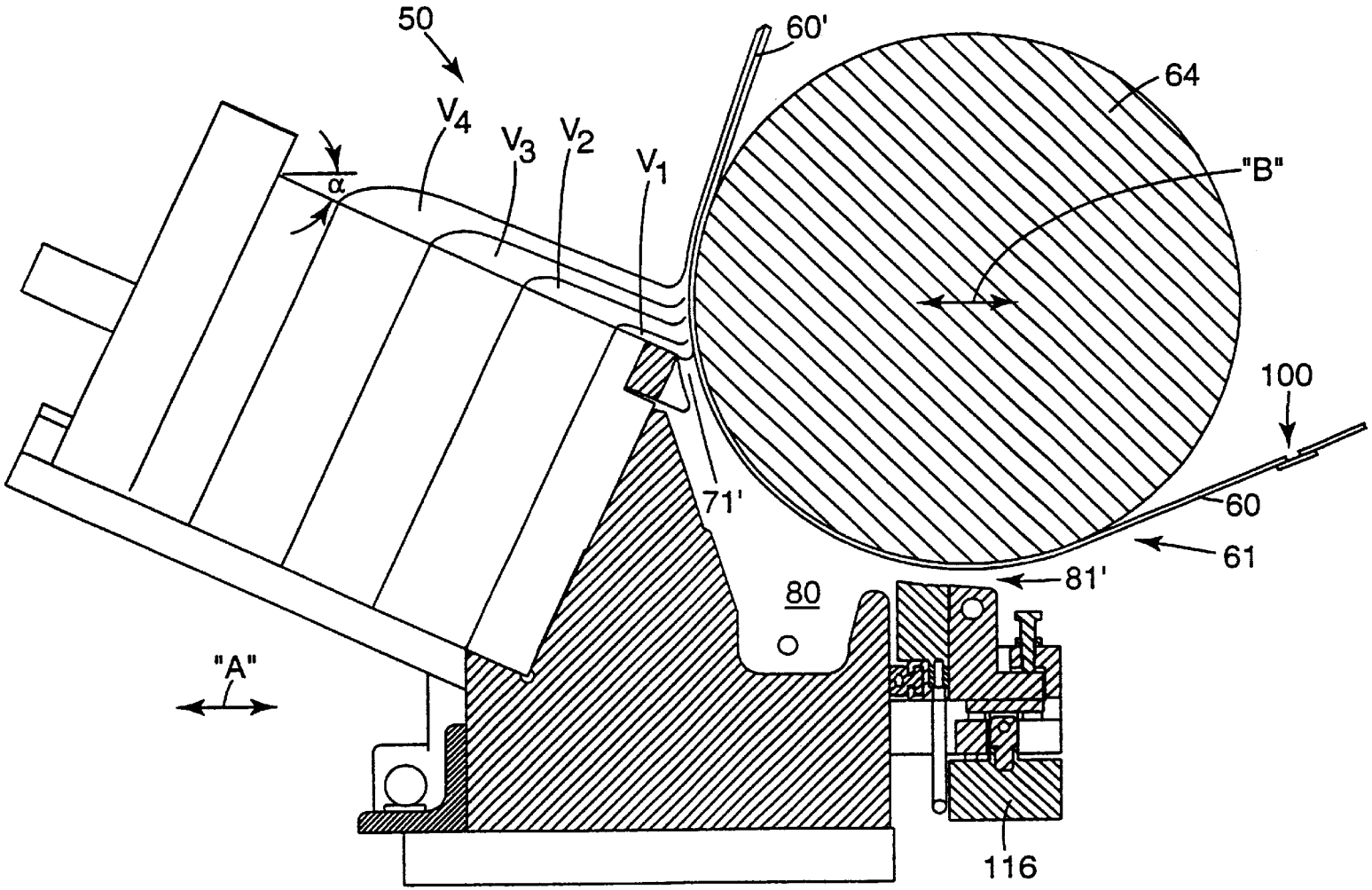
FIG. 4 is a side sectional view of the slide coating assembly of FIG. 2 in a splice coating configuration.

FIGS. 2 through 4 are schematic illustrations of a slide coater assembly 50 for maintaining a stable coating bead while coating over splices 100 on a moving web 60. A series of slide coating bars 52, 54, 56, 58 are positioned in a downward sloping configuration at an angle a (see FIG. 3). One or more coating fluids $V_1$, $V_2$, $V_3$, $V_4$ are extruded through a series of feed slots and are permitted to flow under the force of gravity towards a die edge 62. In the coating position illustrated in FIG. 3, the coating fluids $V_1$, $V_2$, $V_3$, $V_4$ form a coating bead 72 in coating gap 71 which is picked up by the moving web 60 to form the coated article 60'. Formation of the coating bead 72 is typically referred to as "pick up" of the coating fluid.

The die edge 62 is located immediately above a vacuum box 80. A plurality of vacuum ports 67 are located across the width of the vacuum box 80 to minimize air flow resistance and generate a generally uniform vacuum pressure across the width of the coating bead 72. The vacuum box 80 preferably has a front seal 82 that engages with the web 60 upstream from the die edge 62. As best illustrated in FIG. 2, a pair of side seals 84, 86 are located along the sides of the vacuum box 80. In the illustrated embodiment, outer plates 87, 89 surround the side seals 84, 86. The side seals 84, 86 and front seal 82 are pivotally attached to the vacuum box 80 at locations 66, as will be discussed below. The side seals 84, 86 preferably have a radius that corresponds to the radius of supporting roll 64 (or web 60 traversing the support roll 64). Slots may be formed in the edge of the side seals 84, 86 that engage with the supporting roll 64 and/or web 60 so as to enhance the sealing capabilities thereof The coating bead 72 completes the seal between the vacuum box 80 and the moving web 60. A drain (not shown) is located at the bottom of the vacuum box 80 so that excess coating fluid collected in drain chamber 92 can be effectively collected.

FIG. 4 illustrates the splice coating gap 71' between the die edge 62 and the backup roll 64 greater than the coating gap 71. In the preferred embodiment, backup roll 64 is moved to a splice coating position 61 by a hydraulic piston with a check valve arrangement in an air over oil type actuation system, stepper motors, piezoelectric stacks on the mechanical stops, or a variety of other methods known to those of skill in the art. The vacuum gap 81 between the seals 82, 84, 86 and the backup roll 64 is increased to the splice clearance gap 81'. In the illustrated embodiment, increasing the coating gap 71 by a distance "x" does not increase vacuum gap 81 between the front seal 82 and the web 60 by a corresponding distance because the front seal 82 is located around the circumference of the support roll 64. Consequently, the front seal 82 and side seals 84, 86 are rotated clockwise around a pivot point 66 to the splice coating position 85 by the actuator 116, independent of the movement of the backup roll 64 along the axis "B".

The actuator 116 may be located along a bottom edge of the front seal 82 to simultaneously rotate the front seal 82 and side seals 84, 86 to the splice coating position 85 independently of the movement of the backup roll 64. The precise location of the backup roll 64, the front seal 82 and the side seals 84, 86 in both the coating position and the splice coating position is preferably determined by mechanical stops. In an alternate embodiment, the entire vacuum box 80 could rotate away from the web 60 to a splice coating position 85.

Increasing the coating gap 71 to the splice coating gap 71' by moving the support roll 64 along the axis "B" permits the slide coating bars 52–58 to remain substantially fixed and stable during passage of the web splice 100 through the splice coating gap 71'. Additional structural support can be provided to the slide coating bars 52–58 to increase stability and reduce vibration. Retaining the slide coating bars 52–58 in a fixed and stable position permits a greater splice coating gap 71' without destabilizing or breaking the coating bead 72. In an alternate embodiment, the slide coater assembly 50 can be retracted along an axis "A" from the backup roll 64 to form the splice coating gap 71'. In yet another embodiment, both the backup roll 64 and the slide coater assembly 50 can be retracted to form the slide coating positions 61.

In the illustrated embodiment, the coating configuration defines a coating gap 71 between the die edge 62 and the web 60 of about 0.203 millimeters to about 0.381 millimeters (0.008 to 0.015 inch). The front seal 82 forms a coating gap 81 of about 0.178 millimeters (0.007 inch) with the moving web 60. In the splice coating position, the splice coating gap 71' is increased by about 0.635 millimeters (0.025 inch) without destabilizing the coating bead. In the splice coating position 85, the seals 82, 84, 86 are rotated around the pivot point 66 so that the splice clearance gap 81' is about 0.813 millimeters (0.032 inch). Measurements are within about 0.0127 millimeters (±0.0005 inch).

The maximum attainable splice coating gap 71' is dependent upon the viscosity and other properties of the coating fluid, speed of the moving web 60, vacuum, and a variety of other factors. The maximum splice coating gap 71' must be less than the gap at which the coating bead 72 destabilizes, typically less than 3.81 millimeters (0.150 inch) and more typically less than 1.78 millimeters (0.070 inch). The maximum splice coating gap 71' for water based emulsions is typically less. Larger gaps forming a meta-stable coating bead can be used where the splice coating operation is on the order of a few seconds (usually less than 10 seconds).

Figure 5:
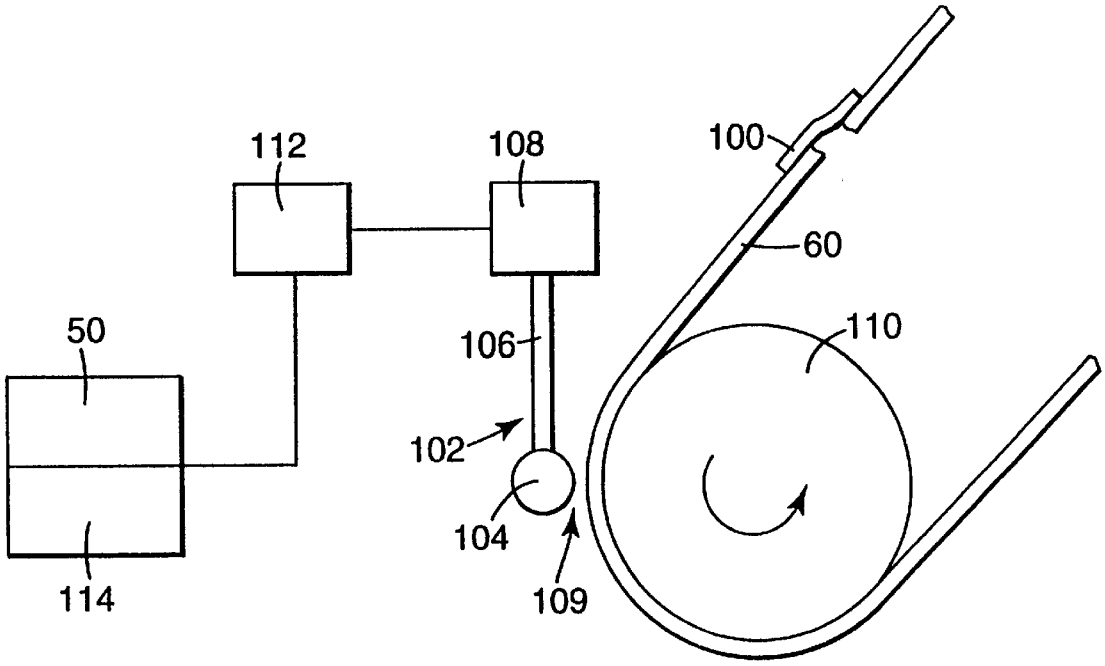
FIG. 5 is a schematic illustration of a splice detector in accordance with the present invention.

A web thickness detector 102 illustrated in FIG. 5 is located after the unwinder/splicer (not shown) and before the vacuum box 80. In the illustrated embodiment, the detector 102 is designed as a straight tube trip bar 104 adjacent an idler roll 110 suspended by a leaf spring 106 attached to an electrical switch 108. A gap 109 is preferably maintained between the web 60 and the trip bar 104 when the web 60 is not moving. The gap 109 is typically about 0.0254 millimeters to about 0.381 millimeters (0.001 to 0.015 inch).

If a splice 100 or other defect in the web 60 is sensed by the detector 102, a signal is sent to a controller 112. The controller 112 increases the coating gap 71 to a splice coating gap 71', typically by moving the support roll 64 along the axis "B" to splice coating position 61, illustrated in FIG. 4. At about the same time, the controller 112 rotates the seals 82, 84, 86 around the pivot point 66 a predetermined distance to splice coating position 85. In the illustrated embodiment, the controller 112 uses the speed of the web 60 and distance from the detector 102 to the die edge 62 to calculate when the splice 100 will reach the die edge 62 and when to adjust the gaps 71, 81 to the coating gaps 71', 81'. Alternatively, a webline controller signals the controller 112 when a splice is made. If the controller 112 detects a splice or other defect in the web 60 in excess of the splice coating gaps 71', 81' (uncoatable splice), the backup roll 64 and seals 82, 84, 86 can be moved to their fully retracted positions. The fully retracted position refers to a coating gap 71 at least large enough to break the coating bead 72. In an alternate embodiment, two thickness detectors 102 could be used. The first is positioned to trigger when a coatable splice passes so that the coater 50 is configured to the splice coating positions 61, 85. The second detector is positioned to trigger when an uncoatable splice passes so that the coater 50 is moved to the fully retracted position.

In an alternate embodiment, the gap 109 and/or sensitivity of the switch 108 can be configured so that only a splice 100 in excess of a predetermined thickness activates the switch 108. In this embodiment, some splices pass the detector 102 without triggering the switch 108. Consequently, the support roll 64 and the seals 82, 84, 86 are not moved to the splice coating positions 61, 85 unless the splice 100 exceeds the predetermined thickness. In yet another embodiment, the switch 108 is a measuring device capable of measuring absolute or incremental increases in web thickness. Absolute or incremental thickness data permits the controller 112 to anticipate an increase in web thickness in excess of the predetermined limit or to alert the operator to possible malfunctions.

In die coating, it is important to keep leaks in the vacuum system to a minimum since excess air flow can destabilize the coating bead. Increasing the coating gap 71 to the splice coating gap 71' allows air to be drawn along the edges of the coating bead 72. Where the die edge 62 is square, there is essentially no resistance to air flow so Bernoulli's equation applies. For example, assuming the height of the die edge 62 is negligible and the initial air velocity is zero, a typical vacuum of 249 Pascals (1 inch column water) in vacuum box 80 will draw air through a 0.254 millimeter (0.010 inch) coating gap along the edges of coating bead 72 at a rate of about 1230 meters/minute (4000 feet/minute) or 0.458 meter$^3$/minute (3.33 ft$^3$/minute) for each 30.48 centimeters (12 inches) of coating gap length.

Figure 6:
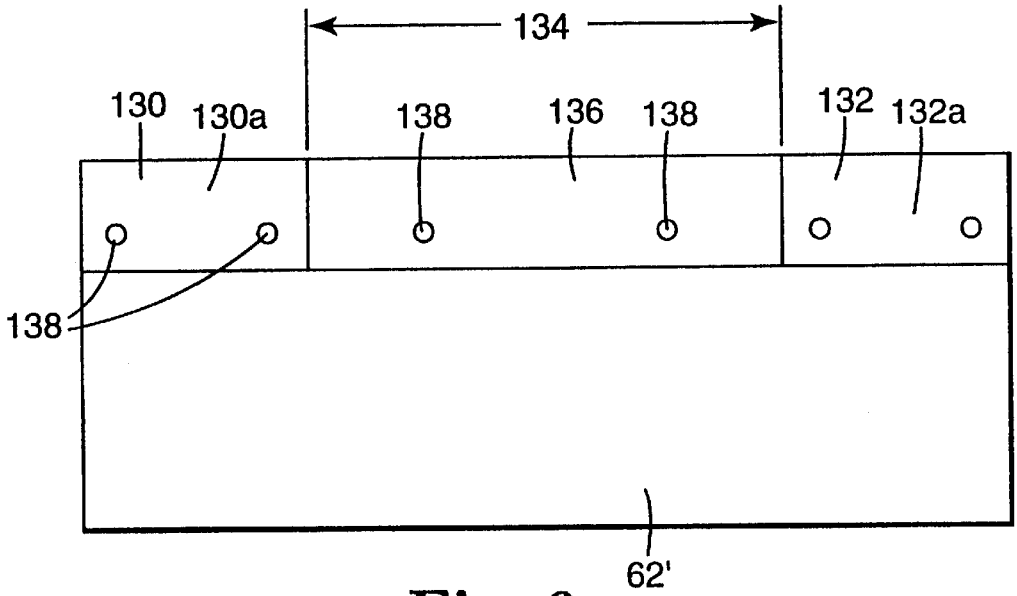
FIG. 6 is a front view of one embodiment of the die edge of a slide coating die in accordance with the present invention.
Figure 7:
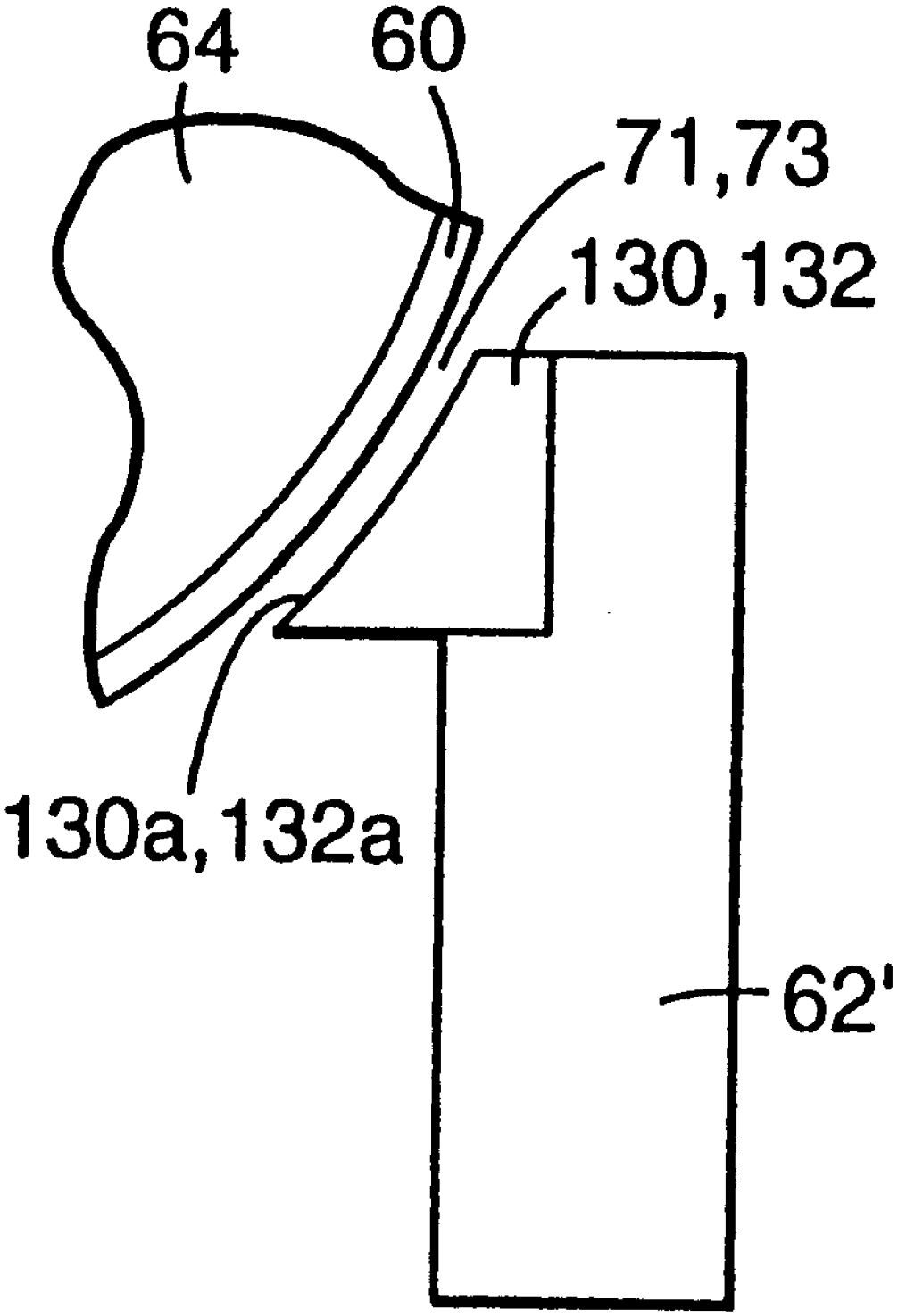
FIG. 7 is an end view of the die edge of a slide coating die of FIG. 6.

In another embodiment of the present invention, the die edge 62 is deckled to minimize vacuum leaks along the splice coating gap 71' that could destabilize the coating bead 72 and adversely affect the coating process. As illustrated in FIGS. 6 and 7, a conventional die edge geometry, such as a square lip, small flat or "ski-jump" design, can be maintained across the coating width 134 of the coating portion 136 of the coating bar 62'. Slide coating bar 62' is constructed with seals 130, 132 that provide vacuum seal lands **130*a*, 132*a* at the edge of the coating width 134. The vacuum seal lands 130*a*, 132*a* preferably have the same radius as the support roll 64 and the web 60. The sealing lands 130*a*, 132*a* provide a vacuum seal to minimize the air flow through the coating gap 71 and slide coating gap 71' into the vacuum box that can adversely affect coating performance. The tortuosity of seal gap 73 increases resistance to air flow that could destabilize the coating bead 72**.

In the embodiment illustrated in FIGS. 6 and 7, the seals 130, 132 and the coating portion 136 are retained to the slide coating bar 62' by fasteners 138, such as screws, so that they are easily changed in the event of damage that might cause streaking or to adjust for different coating widths. The members 130, 132, 136 are typically manufactured from a material such as titanium or stainless steel.

In one embodiment, the distance from sealing lands **130*a*, 132*a* to the web 60 defining the seal gap 73 is about the same as the coating gap 71. The vacuum sealing lands 130*a*, 132*a* preferably have a surface area of about 6.45 millimeters$^2$ to about 645 millimeters$^2$ (0.1 inch$^2$ to about 1.0 inch$^2$) for each 2.54 centimeters (1 inch) of die edge length. The relatively large surface area of the seal lands 130*a*, 132*a* sufficiently restricts the flow of air through the seal gap 73 into the vacuum box 80** to minimize disruption of the coating bead. For example, in a coating configuration with seal lands 19.05 millimeters (0.75 inch) in length, a coating gap of 0.254 millimeter (0.010 inch) and a vacuum of 249 Pascals (1 inch column of water), air is drawn through the coating gap at a rate of 0.86 meter$^3$/minute (0.635 ft$^3$/minute) for each 30.48 centimeters (12 inches)of coating gap length.

The vacuum system 114 is designed to keep a generally uniform vacuum level, regardless of the gaps 71, 81 or splice gaps 71', 81', by utilizing a large capacity blower fan as the vacuum source that can compensate for the leakage. The vacuum system 114 preferably maintains the vacuum box 80 at the lowest possible vacuum, while still maintaining a stable coating bead 72. In the illustrated embodiment, the vacuum system 114 maintains the vacuum box 80 at about 99.6 Pa (0.4 inch water column) to about 747 Pa (3.0 inches water column) during normal coating and splice coating. In one embodiment, the controller 112 signals the vacuum system 114 to increase the flow rate in anticipation of a web splice 100 and the resulting leakage around the vacuum box 80 so as to maintain a generally stable pressure in the vacuum box 80. A method for adjusting flow rates in a vacuum system is discussed in U.S. Pat. No. 5,154,951 (Finnicum et al.). Alternatively, a solenoid operated valve could be positioned to vent the vacuum line to the vacuum box, thereby reducing the vacuum during coating. The valve would be in the open position during normal coating. The valve would be closed during splice coating to increase the vacuum to compensate for leakage around the vacuum box 80. An adjustable valve could be placed in the venting line so that the leak to the vacuum system through the solenoid valve during normal coating corresponds to the leakage around the vacuum box in the splice coating position.

The internal volume of the duct work for the vacuum system 114 is preferably extremely large (by a factor of 5 or more) in relation to the volume of the vacuum chamber 92. The large volume of the duct work tends to dampen or attenuate changes in vacuum caused by the splice gaps 71', 81'. To a certain extent, the duct work volume acts like a reservoir of vacuum. The vacuum connection from the vacuum system 114 is well distributed across the front edge of the vacuum box 80 by vacuum ports 67 to provide uniformity of vacuum across the width of the coating bead 72. Arranging the vacuum ports 67 near the front seal 82 also permits major leaks along the front seal 82 to be pulled out to the vacuum system 114 before entering the main vacuum chamber 92. In the illustrated embodiment, the vacuum blower is a standard industrial blower available from New York Blower located in Willowbrook, Ill. under model number 1404. The blower is preferably operated at a small fraction of its rated capacity so that its suction pressure is nearly independent of the volume of air flowing through the blower. The speed of the blower is controlled by a DC drive system for accurate pressure control.

Various methods of coating a plurality of fluid layers onto a substrate are disclosed in commonly assigned U.S. Pat. Nos. 5,861,195; 5,843,530; and 5,849,363. Additional disclosure relating to a slide coater assembly is set forth in commonly assigned U.S. patent application Ser. No. 08/177,288 entitled "Coater Die Enclosure System, filed Jan. 4, 1995, and U.S. Pat. No. 5,725,665.

Any coated material, such as graphic arts materials, non-imaging materials such as adhesives and data storage media, and imaging materials such as photographic, photothermographic, thermographic, photoresists and photopolymers, can be coated using the method and apparatus of the present invention. Materials particularly suited for coating using the present method and apparatus include photothermographic imaging constructions (e.g., silver halide-containing photo sensitive articles which are developed with heat rather than with a processing liquid). Photothermographic constructions or articles are also known as "dry silver" compositions or emulsions and generally comprise a substrate or support (such as paper, plastics, metals, glass, and the like) having coated thereon: (a) a photosensitive compound that generates silver atoms when irradiated; (b) a non-photosensitive, reducible silver source; (c) a reducing agent (i.e., a developer) for silver ion, for example, for the silver ion in the non-photosensitive, reducible silver source; and (d) a binder.

Thermographic imaging constructions (e.g., heat-developable articles) can also be coated using the method and apparatus of the present invention. These articles generally comprise a substrate (such as paper, plastics, metals, glass, and the like) having coated thereon: (a) a thermally-sensitive, reducible silver source; (b) a reducing agent for the thermally-sensitive, reducible silver source (i.e., a developer); and (c) a binder.

Photothermographic, thermographic, and photographic emulsions used in the present invention can be coated on a wide variety of substrates. The substrate (also known as a web or support) 60 can be selected from a wide range of materials depending on the imaging requirement. Substrates may be transparent, translucent, or opaque. Typical substrates include polyester film (e.g., polyethylene terephthalate or polyethylene naphthalate), cellulose acetate film, cellulose ester film, polyvinyl acetal film, polyolefinic film (e.g., polyethylene or polypropylene or blends thereof), polycarbonate film, and related or resinous materials, as well as aluminum, glass, paper, and the like.

All patents and patent applications cited above are hereby incorporated by reference. The present invention has now been described with reference to several embodiments described herein. It will be apparent to those skilled in the art that many changes can be made in the embodiments without departing from the scope of the invention. Thus, the scope of the present invention should not be limited to the structures or methods described herein, but only to structures and methods described by the language of the claims and the equivalents thereto.

What is claimed is:

1. A method for continuous coating of a moving web and splices with a coating fluid, comprising the steps of:

positioning a coating die in a coating position to comprise a coating gap with a moving web;

positioning a vacuum system in a coating position to comprise a vacuum gap with the moving web;

guiding the moving web in a first direction past the coating die such that a coating bead of the coating fluid is formed in the coating gap to apply a coating on the moving web;

generating a reduced pressure condition along a lower surface of the coating bead;

signaling an increase in web thickness to a controller;

generating a signal in the controller to automatically adjust the vacuum gap to a splice clearance gap in a splice coating position during continuous coating of the coating fluid in response to the signal of the increase in web thickness; and generating a signal in the controller to automatically adjust the coating gap to a splice coating gap of the splice coating position independently of the vacuum gap in response an increase in web thickness in excess of a predetermined magnitude while maintaining a stable coating bead during continuous coating of the coating fluid.

2. The method of claim 1 further comprising the steps of adjusting the coating gap and the vacuum gap to the coating position in response a decrease in web thickness.

3. The method of claim 1 further comprising adjusting the coating gap and the vacuum gap to a fully retracted position in response to detecting an increase in web thickness in excess of the splice coating gap.

4. The method of claim 1, wherein the increase in web thickness comprises a web splice.

5. The method of claim 1 wherein the step of adjusting the vacuum gap comprises rotating a front seal of the vacuum system located upstream of the coating gap away from the moving web.

6. The method of claim 1 wherein the step of adjusting the coating gap comprises the step of moving a support roll horizontally away from the coating gap to the splice coating position.

7. The method of claim 1 further comprising the step of increasing a magnitude of the reduced pressure condition in response to a detector signaling an increase in web thickness.

8. The method of claim 7 wherein increasing the magnitude of the reduced pressure condition is done in anticipation of an increase in web thickness reaching the coating gap.

9. The method of claim 7 wherein the coating die comprises a die edge having a centrally located coating portion interposed between a pair of coating gap seals, the coating gap seals comprising vacuum seal land areas having a contour corresponding to a contour of the web guide.

10. The method of claim 7, wherein the coating gap in the splice coating position comprises between about 0.127 millimeter and about 3.81 millimeters.

11. The method of claim 1, wherein the coating die comprises a slide coating die.

12. A web coating apparatus for continuously coating a coating fluid over a splice on a moving web, comprising:

a coating die comprising a coating gap with the moving web in a coating position and comprising a splice coating gap in a splice coating postition, the coating gap being adjustable between the coating position and the splice coating position during continuous coating of the coating fluid;

a web guide positioned to guide the moving web in a first direction past the coating die such that a coating bead of the coating fluid can be formed in the coating gap;

a vacuum system positioned to generate a reduced pressure condition along a lower surface of the coating die, the vacuum system comprising a vacuum gap with the moving web in the coating position and comprising a splice clearance gap in the splice coating position, the vacuum gap being adjustable independent of the coating gap between the coating position and the splice coating position during continuous coating of the coating fluid;

a detector for signaling an increase in web thickness; and a controller functionally connected to the detector adapted to automatically and independently adjust the coating gap of the coating die and the vacuum gap of the vacuum system from the coating position to their respective splice coating positions in response to an increase in web thickness in excess of a predetermined magnitude while maintaining a stable coating bead.

13. The apparatus of claim 12, wherein the controller is capable of adjusting the coating gap and the vacuum gap to the coating position in response to the detector signaling a reduction in web thickness.

14. The apparatus of claim 12 wherein the controller is capable of adjusting the coating gap and the vacuum gap to a fully retracted position in response to the detector signaling an increase in web thickness in excess of the splice coating gap.

15. The apparatus of claim 12, wherein the increase in web thickness comprises a web splice.

16. The apparatus of claim 12 wherein the vacuum system comprises a vacuum box with a front seal opposite the moving web upstream of the coating gap, the front seal rotating away from the moving web in the splice coating position to form the splice clearance gap.

17. The apparatus of claim 12, wherein the web guide comprises a support roll, the support roll moving horizontally away from the coating gap in the splice coating position.

18. The apparatus of claim 12, wherein the controller is capable of altering a magnitude of the reduced pressure condition in response to the detector signaling an increase in web thickness.

19. The apparatus of claim 12, wherein the controller is capable of altering a magnitude of the reduced pressure condition in response to adjusting the coating gap and vacuum gap to the splice coating position.

20. The apparatus of claim 12, wherein the coating die comprises a slide coating die with a die edge having a centrally located coating portion interposed between a pair of coating gap seals, the coating gap seals comprising vacuum seal land areas having a contour corresponding to a contour of the web guide.

21. The apparatus of claim 12, wherein the detector signals incremental increases in web thickness.

22. The apparatus of claim 12, wherein the coating gap in the splice coating position comprises between about 0.127 millimeter and about 3.81 millimeters.

23. The apparatus of claim 12, wherein the detector comprises:

a first detector positioned to detect an increase in the web thickness in excess of a first magnitude; and a second detector positioned to detect an increase in the web thickness in excess of a second magnitude.

24. The apparatus of claim 12, wherein the coating die comprises a slide coating die having a slide surface with at least one feed slot for coating the coating fluid onto the moving web.

* * * * *

UNITED STATES PATENT AND TRADEMARK OFFICE

CERTIFICATE OF CORRECTION

PATENT NO. : 6,576,296 B1
DATED : June 10, 2003
INVENTOR(S) : Yapel, Robert A.

It is certified that error appears in the above-identified patent and that said Letters Patent is hereby corrected as shown below:

Column 5,
Lines 58 and 62, before “gaps” delete “coating”.

Column 8,
Line 67, before “an” insert -- to --.

Signed and Sealed this

Tenth Day of May, 2005

JON W. DUDAS
*Director of the United States Patent and Trademark Office*